United States Patent [19]

Kotitschke et al.

[11] Patent Number: 4,610,097

[45] Date of Patent: Sep. 9, 1986

[54] DEVICE FOR THREADING A TRANSFER STRIP OF A PAPER WEB THROUGH THE DRYING CYLINDER SECTION OF A PAPER MACHINE

[75] Inventors: Gerhard Kotitschke; Wilheim Benz, both of Heidenheim, Fed. Rep. of Germany

[73] Assignee: J. M. Voith GmbH, Heidenheim, Fed. Rep. of Germany

[21] Appl. No.: 676,546

[22] Filed: Nov. 30, 1984

[30] Foreign Application Priority Data

Dec. 7, 1983 [DE] Fed. Rep. of Germany ..... 3344216

[51] Int. Cl.[4] ..... F26B 13/10

[52] U.S. Cl. ..... 34/117; 34/120; 226/91; 242/195

[58] Field of Search ..... 226/91, 92; 242/195; 34/117, 120, 116

[56] References Cited

U.S. PATENT DOCUMENTS 2,529,184 11/1950 Pearson ..... 226/92

FOREIGN PATENT DOCUMENTS 891240 3/1944 France ..... 34/120

*Primary Examiner*—Larry I. Schwartz

*Attorney, Agent, or Firm*—Albert L. Jeffers; Stephen T. Belsheim

[57] ABSTRACT

A narrow guide belt runs in the edge area of the paper web width across the drying cylinder of a paper machine and serves to thread the transfer strip through the drying cylinder section. On each drying cylinder, about in the center of the looping zone formed by the guide belt on the drying cylinder, two or three guide belt pulleys are so arranged that the belt will for a short distance lift off the cylinder. The pulleys can be swiveled in a position spaced from the drying cylinder where the guide belt lifts entirely off the cylinder.

7 Claims, 5 Drawing Figures

DEVICE FOR THREADING A TRANSFER STRIP OF A PAPER WEB THROUGH THE DRYING CYLINDER SECTION OF A PAPER MACHINE

BACKGROUND OF THE INVENTION

The invention concerns a device for transferring a paper web from the press section to the drying section of a paper machine.

Most modern paper machines use rope carriers for "threading" the paper web, such as after a standstill or web break, into the drying section of the peper machine. The drying section normally consists of several drying cylinder groups, each group having several drying cylinders. These rope carriers are designed as set out below. In each drying cylinder group, two ropes run along the path of the paper web. To start the transfer operation one introduces a narrow edge strip of the paper web, the so-called transfer strip, in the drying cylinder group. At the end of the drying cylinder group, the transfer strip is passed to the next drying cylinder group.

During this threading phase, the remaining part of the paper web is passed from the screen or from one of the press rolls to a scrap collection container. Next, the transfer strip is widened until it reaches the full width of the web so that, lastly, the entire paper web is passing through the drying section.

As commonly known, the rope carrier is located on the tending aisle edge of the drying cylinders so as to be outside the paper web width. Therefore, the transfer strip must be diverted sideways from its normal path before the point at which the transfer strip enters the rope carrier. A prior rope carrier has been described in the German Patent Publication No. 1,022,900 (to which U.S. Pat. No. 2,716,291 is a counterpart). Two ropes are always used which form a rope carrier since the leading end of the transfer strip is pinched between the two ropes.

Another previously known arrangement (such as in German Patent Publication No. 23 65 438 which is similar to U.S. Pat. No. 4,000,035), is a so-called contact felt group. The contact felt group uses a narrow guide belt instead of a pair of ropes. This belt can proceed through a drying cylinder group on two different courses. It runs either in an ineffective position alongside and outside the paper web width, as during the normal production operation, or it runs at the edge of the paper web and within its width. The latter position is assumed, for instance, with the aid of laterally shiftable pulleys, when a threading operation is to take place. The belt carrier can thus thread the transfer strip into the drying cylinder group within the paper web width, and it is not necessary to divert the transfer strip leader sideways as in the case of the rope carrier. The transfer strip rather runs from the outside in its normal position between the belt carrier and the drying felt or drying screen. Upon completed threading, the belt carrier must be moved sideways out of the paper web area into its ineffective position. The belt carrier runs now on the outer edge of the drying cylinder. For the next transfer operation it must be moved again into the area of the paper web.

In the belt carrier described above, a single rope acting in the same fashion as the belt could be used as well instead of it. The term "guide belt" comprises hereafter also a single rope, and whereas the term "rope" is always part of a rope carrier featuring a pair of ropes.

The prior devices have proved themselves. But sometimes it is disadvantages that the belt carrier and/or rope carrier must during the entire operating time of the paper machine continually revolve at the speed of rotation of the drying cylinders. Attempts have already been made at eliminating this disadvantage by providing on each drying cylinder a loose rim for the belt and/or the rope pair (see German Patent Publication No. 1,002,900). Such rims also provide for different speeds between the drying cylinders and the belt and/or the ropes. But the design expense for loose rims is extremely high. In addition, they must be serviced in regular intervals.

SUMMARY OF THE INVENTION

The invention provides a device for threading a transfer strip through the drying cylinder of a paper machine that overcomes the above disadvantages. In the device of the invention, the guide belt and/or the rope pair can, on at least one drying cylinder, independent of its rotation, rotate or stand still without requiring the prior loose rims.

The invention provides a device for threading a transfer strip through the drying cylinder section of a paper machine wherein one or several of the pulleys are adjustable in such a way that the belt and/or pair of ropes can be lifted off at least one of the drying cylinders as required. Various embodiments and arrangement examples will be explained hereinafter.

The device of the invention is especially applicable to a drying cylinder arrangement where at least in the first drying cylinder group a single endless backing belt (e.g. a drying felt or a drying screen) is provided which alternately runs across the upper and lower drying cylinders. These drying cylinders lie alternately outside and inside the backing belt loop. The arrangement is preferably such that the drying cylinders of the upper cylinder row are located outside the belt loop while the drying cylinders of the lower row are located inside the loop.

There are two possibilities of utilizing the device of the invention in such a drying cylinder section and these are described hereinafter. In one arrangement a guide belt is present (since this embodiment is less suited for a rope carrier) and is positioned so that in a specific drying cylinder group the belt makes contact only with the drying cylinders located inside the backing belt loop. In other words, the belt makes contact only with the drying cylinders of the lower cylinder row. It is further provided that on each of these drying cylinders the guide belt can be completely lifted off the cylinder surface with the aid of the invention which includes shiftable pulleys. This makes it possible for the guide belt to remain constantly in the area or plane of the paper web edge or transfer strip. In other words, the belt is positioned so as to be inside the paper web width so that it need not be shifted back and forth sideways to bring it to a standstill after each successfully threading of the transfer strip. This possibility represents an important progressive step for paper machines operating at extremely high speeds (e.g. 1500 m/min). Prior threading devices have been required to rotate constantly at such high speeds, and thus, are subject to increased wear. By rotating at such high speeds prior threading devices have also represented an accident hazard.

In the second arrangement the device of the invention is applied to a situation where there are two successive contact felt cylinder groups. So far it has sometimes been unsatisfactory that the transfer strip must be passed at the point of separation between the two contact felt cylinder groups by the threading device of the first cylinder group to the threading device of the second cylinder group. The device of the invention now provides that the threading device, i.e., the guide belt or pair of ropes, of the first cylinder group will loop around only part of the first cylinder of the second cylinder group and can be lifted off that first cylinder with the aid of the device of the invention which includes shiftable pulleys. While with this arrangement the threading device of the first cylinder group does continually rotate with it, the advantage is nevertheless that in the event of interruptions (e.g., when changing the drying felt or drying screen) the respective cylinder group can be brought to a standstill independently from the adjoining cylinder group(s).

In German Patent Publication No. 1,233,711 there appears to be shown a threading device which features at various points pulleys which in the plane of the path of the ropes are shiftable between two positions. However, in the patent publication, an entirely different problem from the present one is being addressed. The objective there is to provide an arrangement for varying for a specific rope the looping angle on a cylinder or a roll and selectively causing the paper web to either pass through a sizing press or to bypass it.

The above-mentioned and other features and objects of this invention and the manner of attaining them will become more apparent and the invention itself will be best understood by reference to the following description of embodiments of the invention taken in conjunction with the accompanying drawings.

DETAILED DESCRIPTION OF SPECIFIC EMBODIMENTS

Figure 1:
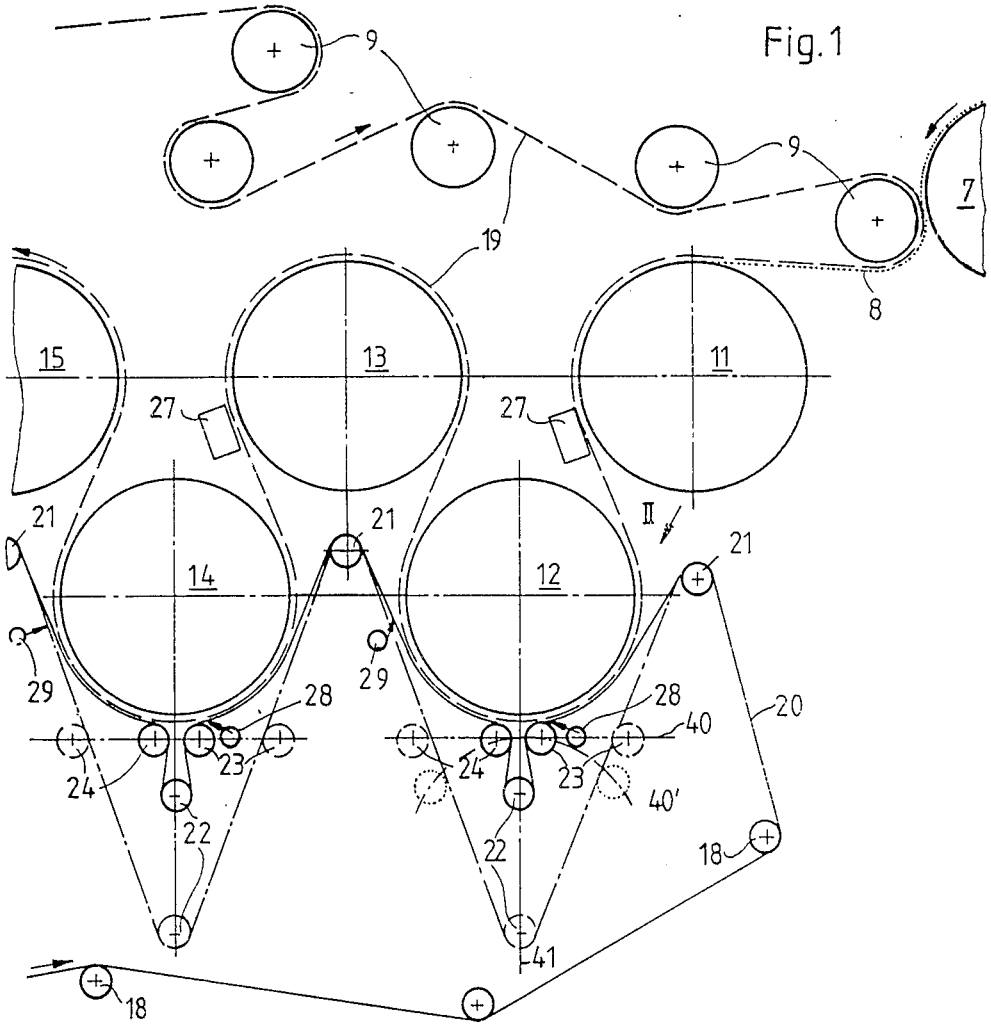
FIG. 1 shows schematically the beginning part of a drying cylinder section with a disengageable guide belt.

Referring to FIG. 1, there are illustrated the first five drying cylinders 11 through 15 of a contact felt cylinder group forming the leading part of a drying cylinder section. An endless backing belt 19, which is of a machine-wide width, runs across cylinders 11 through 15. More specifically, as shown in FIG. 1, backing belt 19 runs alternately across the upper (11, 13, 15) and lower cylinders (12, 14). This backing belt 19 carries the paper web through the entire cylinder group. From the last cylinder, which is not visible, the backing belt 19 runs over guide rolls 9, above the cylinder group, and back to the cylinder 11. Hence, the cylinders 11, 13 and 15 of the upper cylinder row are outside the backing belt loop while cylinders 12 and 14 of the lower cylinder row are inside the backing belt loop. The backing belt 19 also transfers the paper web 8 from the press section to the drying cylinder section. A press roll 7 is partly visible in FIG. 1. The paper web 8 is illustrated by a dotted line in the transfer zone. Inside the drying cylinder section illustration of the paper web has been omitted.

A narrow, endless belt 20 serving the threading of a narrow edge strip of the paper web, the so-called transfer strip, in the drying cylinder section runs successively across the lower cylinder area of the drying cylinders 12 and 14 of the lower cylinder row and, additionally, over appropriately arranged pulleys 18 and 21 through 24. The normal path of the belt 20 is illustrated by a solid line. Some of the pulleys 21 are permanently installed beside and/or between the lower cylinders 12, 14. Further pulleys 18 are arranged below the drying cylinder section. The guide belt runs over these pulleys 18 from the last lower cylinder (not visible) back to the first lower cylinder 12. In addition, three pulleys 22 through 24 are arranged on each of the lower cylinders 12, 14 so as to positioned about in the center of the looping zone formed by the guide belt around the cylinder. Pulley 22–24 are arranged so that the guide belt will be lifted off the cylinder wall for a short distance by pulleys 22–24 and form a loop. Referring to these three pulleys, the center pulley 22 is arranged between the guide belt and the drying cylinders. In other words, center pulley 22 is positioned so as to be outside of the guide belt loop. The lateral pulleys 23 and 24 are arranged within the guide belt loop. The pulley position illustrated by solid lines is the so-called "first" position, which could as well be called the "working position".

The dashed lines in FIG. 1 illustrate that the center pulley 22 can be swiveled or moved down (as viewed in FIG. 1) and the other pulleys 23 and 24 swiveled or moved sideways (as viewed in FIG. 1). The pulley position illustrated by the dashed lines is the so-called "second" position, which could as well be called the "inoperative position". In this "second" (or inoperative) position of the pulleys 22, 23 and 24, the belt 20 extends along the dashed lines so as to be a certain distance from the drying cylinders 12 and 14. When the belt 20 assumes this position on all of the lower drying cylinders, the movement of belt 20 can be brought to a standstill even while the paper machine continues to run. When the pulleys 22–24 are in the above-mentioned "second" position (illustrated by dashed lines), the length of the guide belt sections extending between pulleys 21 and 22 is greater than the same length of the guide belt sections extending between these pulleys when the pulleys 22–24 are in the so-called "first" position illustrated by solid lines. The greater guide belt length can be accommodated through the release action of a belt tensioning device (not illustrated).

The sideways shift of the pulleys 23 and 24 is indicated by a generally horizontal straight line 40. In other words, the movement of pulleys 23 and 24 would be generally along line 40. It is also possible to swing out the pulleys 23, 24 along an arc 40'. The rest position pulleys 23, 24 is shown by the dotted circles in FIG. 1. The pulley 22 preferably swivels or moves in a generally vertical direction and may be, for example, a tensioning pulley operated by a weight.

Figure 2:
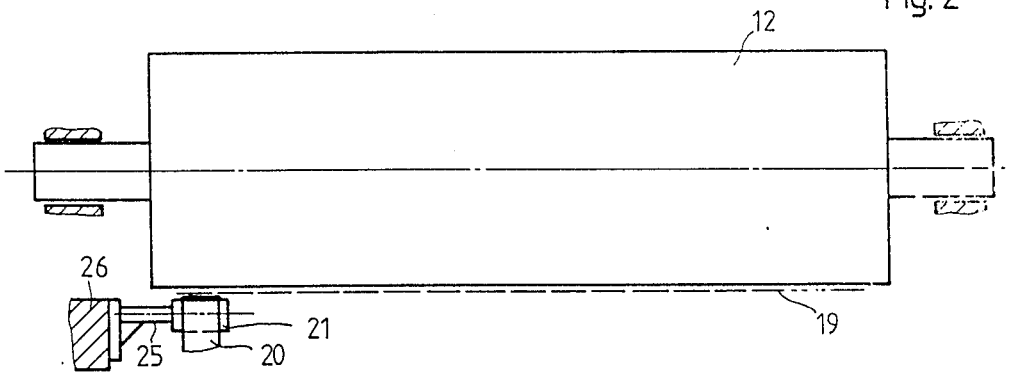
FIG. 2 is a partial view in the direction of arrow II in FIG. 1.

FIG. 2 schematically shows the cylinder 12 with the machinewide backing belt 19 and the narrow guide belt 20 running across the pulley 21 mounted on an arm 24 which is fastened on the machine frame 26. The belt 20 is constantly in the edge zone of the backing belt 19.

In threading, the transfer strip is first introduced in the gap between the backing belt 19 and the upper cylinder 11 (FIG. 1). At the exit gap of the cylinder 11, a small vacuum box 27 may be arranged especially for the transfer strip. Vacuum box 27 ensures that the transfer strip proceeds along with the backing belt 19 to the first lower cylinder 12. Once at the first lower cylinder 12, the transfer strip is grabbed by the belt 20 and slung around the lower wall of the cylinder 12 where the transfer strip is contained between the backing belt 19 and the guide belt 20. Similar suction boxes 27 may be arranged also on the other upper cylinders 13, 15.

To ensure that the transfer strip continues to proceed along with the backing belt 19 across the lower cylinder in the area of pulleys 23 and as the transfer strip leaves the point of the guide belt from the cylinder 12 and/or 14, air nozzles 28 and/or 29 can be arranged as illustrated.

Figure 3:
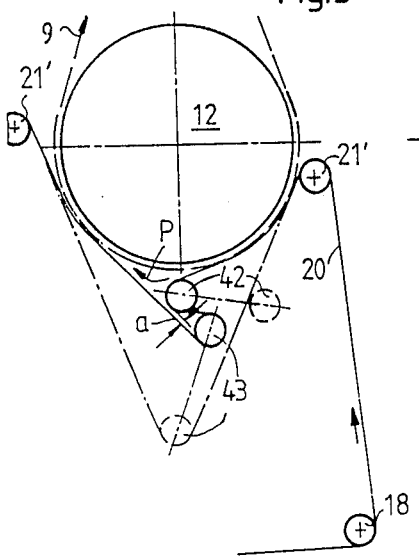
FIGS. 3 and 4 show sections of FIG. 1 with different arrangements of the belt pulleys.

FIG. 3 shows a pulley arrangement on cylinder 12 of the cylinder group shown in FIG. 1 which varies from FIG. 1. It should be mentioned that the pulley arrangement of FIG. 3 can also be used in conjunction with further lower cylinders 14. Two fixed pulleys 21' are positioned beside the cylinder 12. Two adjustable pulleys 42 and 43 are located in the area of the looping zone of the drying cylinder 12. These latter pulleys (42, 43) are again illustrated by solid lines in their first position (the working position) and by dashed lines in their second position (the inoperative position). When the pulleys 42 and 43 are in their working position, the belt 20 runs from the cylinder 12 first across the first pulley 42 and then to pulley 43. It is considered essential that the guide belt on its further course from the second pulley 43 back to the cylinder 12 passes the first pulley 42 at a smaller distance a. Should the transfer strip ever separate from the cylinder 12, the transfer strip will consequently run upward again from the pulley 42, without the necessity of air (refer to arrow P). One might also say that a forced guidance of the transfer strip is thus obtained.

Figure 4:
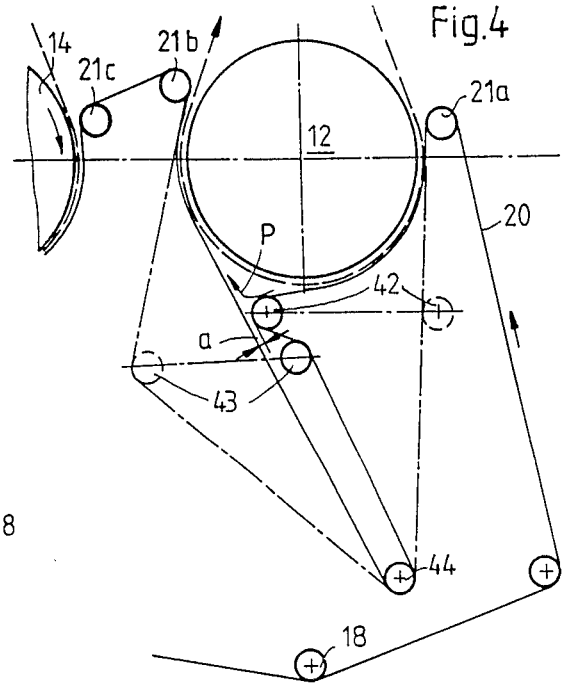

The same effect can be achieved with the arrangement according to FIG. 4. But this arrangement is improved over FIG. 3 insofar as the guide belt 20 loops around the cylinder 12 in larger areas. This is first accomplished through positioning fixed pulleys 21*a* and 21*b* at positions that are higher than those in the arrangement of FIG. 3. Accordingly, an additional pulley 21*c* is provided between the two cylinders 12 and 14. Further, a third pulley 44 is provided, in addition to the two adjustable pulleys 42 and 43, which is arranged outside the guide belt loop the same as the second pulley 43. Pulley 44 is positioned a relatively large distance from the cylinder 12. This third pulley 44 can generally be installed as a fixed pulley. The swivel paths of the two movable pulleys 42 and 43 run approximately horizontally. It is unique that the second pulley 43 makes in its working position contact with the section of the guide belt 20 that runs downward to the third pulley 44, whereas in its inoperative position second pulley 43 makes contact with the section of guide belt 20 running from the third pulley 43 upward to the pulley 21*b*.

With the embodiments according to FIGS. 3 and 4, the pulleys 42 and 43 are arranged relative to one another so that a longitudinal adjustment of the guide belt 20 is obtained as the movable pulleys 42 and 43 are swiveled. In other words, the presence of a tensioning device is not necessary to maintain guide belt 20 taunt.

Figure 5:
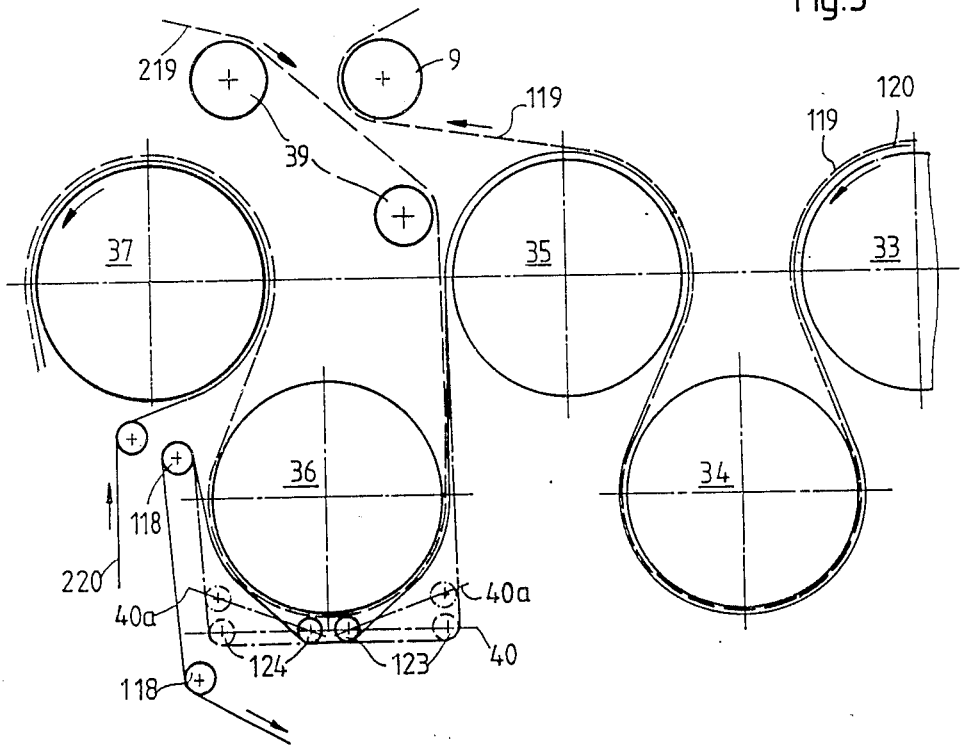
FIG. 5 shows a section of a drying cylinder battery which differs from that according to FIGS. 1 through 4, and at that, at the point of separation between two contact felt cylinder groups.

Referring to the specific embodiment illustrated in FIG. 5, a first guide belt 120 runs together with a first backing belt 119 (drying screen) alternately across the upper and lower drying cylinders of a first contact felt cylinder group. FIG. 5 illustrates the last three cylinders 33, 34 and 35 and a guide roll 9 of this group. The subsequent second contact felt cylinder group includes two cylinders 36 and 37, a second backing belt 219 with rolls 39, and a second guide belt 220 which are illustrated in FIG. 5. Unique on this arrangement is that the first guide belt 120, after leaving the last cylinder 35 of the first cylinder group, runs now together with the backing belt 219 of the second cylinder group over the first cylinder 36 of this cylinder group. In the lower area of the looping zone of cylinder 36, the guide belt 120 runs over swivel pulleys 123 and 124. In this embodiment, the two pulleys are directly adjacent to one another, and they can be shifted sideways into a position illustrated by dashed lines. When pulleys 123 and 124 shift, they cause the guide belt 120 to lift off the cylinder 36. The shifting path is again illustrated by a line 40, which may deviate from the horizontal; for instance, each pulley can be moved in the dash-dotted position along an oblique upward path 40*a*. After passing pulley 124, first guide belt 120 then runs up and over and down and past pulleys 118 back toward the beginning of the first cylinder group.

The arrangement according to FIG. 5 facilitates the strip transfer from one cylinder group to the other cylinder group. The guide belt 120 will be lifted off the cylinder 36 when outside the normal paper machine operation the two cylinder groups run at a considerable speed differential or when one of the cylinder groups must be stopped independently from the other. In variation from the embodiments illustrated in FIGS. 1 through 4, the guide belts 120 and 220 of the specific embodiment illustrated in FIG. 5, as explained initially, need to be moved transverse to the direction of travel from the outer cylinder edge into the edge area of the paper web width, for a transfer process, and back again upon completion of the process.

The arrangement shown in FIG. 5, specifically with movable pulleys 123 and 124, can basically be used also with a rope carrier. In this case, a pair of ropes are used in lieu of each of the guide belts 120 and 220. In variation from the embodiment of FIG. 2, the ropes in the embodiment of FIG. 5 run continually beside the backing belt.

While there have been described above the principles of this invention in connection with specific apparatus, it is to be clearly understood that this description is made only by way of example and not as a limitation to the scope of the invention.

What is claimed is:

1. An apparatus for threading a transfer strip of a paper web through the drying cylinder section of a paper machine comprising:

a pulley assembly;

an endless elongate guide member carried by said pulley assembly, said pulley assembly being positioned relative to said drying cylinder assembly so that said guide member facilitates the transfer strip being passed across the circumference of one or more of the drying cylinders of the drying cylinder section;

said pulley assembly including a movable pulley means, positioned adjacent a selected one of the drying cylinders, for moving between two positions, when said movable pulley means is in its first position said guide member is permitted to loop around a portion of the selected drying cylinder and when said movable pulley means is moved into its second position said movable pulley means is moved into its second position said guide member is moved away from the selected drying cylinder so as to be spaced apart from the selected drying cylinder;

said pulley means includes a pair of movable pulleys positioned in the area of the wrapped zone of the selected drying cylinder, a first one of said pulley is arranged inside the loop of said guide member so that when said movable pulley means is in its first position said first pulley is positioned in the immediate vicinity of the selected drying cylinder wall, and a second one of said movable pulleys is arranged outside the loop of the guide belt member so that when said pulley means is in its first position said second pulley is positioned near said first pulley; and when said pulley means is in its first position said guide member follows a path from the selected cylinder over said first pulley to said second pulley and then passes at a slight distance apart from the first pulley back to the selected cylinder.

2. The apparatus according to claim 1 wherein said movable pulleys are positioned so as to be approximately in the center of the looping zone which the guide member forms on the selected drying cylinder, said movable pulleys are equi-spaced from the selected drying cylinder, and said movable pulleys move between their positions which correspond to the first and second positions of said pulley means along a path that is approximately tangential to an imaginary circle of an arc which is concentric with the cylinder wall.

3. The apparatus of claim 1 or 2, wherein said pair of movable pulleys are located outside the loop of said endless guide member so as to be between said guide member and the selected drying cylinder.

4. The apparatus to claim 1 or 2, wherein said pair of movable pulleys are located inside the loop of the guide member, and said pulley means further including a third pulley positioned in the area of the looping zone of the selected drying cylinder between said movable pulleys, and said third pulley is arranged outside of the endless loop of said guide member.

5. The apparatus according to claim 1 wherein said pulley means further includes a third pulley positoned a large distance from the selected cylinder and outside of the guide member loop, said guide member runs over said third pulley so as to route the guide member with said movable pulleys in their position corresponding to the first position of said pulley means from the second pulley back to the selected drying cylinder while maintaining said guide member the slight distance from the first pulley.

6. The apparatus of claim 5 wherein the drying cylinder section includes a set of upper drying cylinders and a set of lower drying cylinders, an endless backing belt runs alternately over the upper and lower drying cylinders so that the drying cylinders alternately lie outside and inside the backing belt loop, said guide member makes contact only with those ones of the drying cylinders which lie inside the backing belt loop.

7. The apparatus of claim 6 wherein said guide member is located constantly in the plane of the transfer strip.

* * * * *

UNITED STATES PATENT AND TRADEMARK OFFICE

CERTIFICATE OF CORRECTION

PATENT NO. : 4,610,097

DATED : September 9, 1986

INVENTOR(S) : Gerhard Kotitschke

It is certified that error appears in the above-identified patent and that said Letters Patent is hereby corrected as shown below:

Col. 1, line 13, change "peper" to --paper--

Claim 1, Col. 7, lines 1-2, delete "said movable pulley means is moved into its second position"

Claim 1, Col. 7, line 8, change "pulley" to --pulleys--

Claim 4, Col. 8, line 1, change "to" to --of--

Signed and Sealed this

Tenth Day of February, 1987

*Attest:*

DONALD J. QUIGG

*Attesting Officer*

*Commissioner of Patents and Trademarks*